United States Patent [19]

Bollmer

[11] 4,131,040

[45] Dec. 26, 1978

[54] PRINTING BLANKET HOLE FORMING APPARATUS AND METHOD

[75] Inventor: Jacob A. Bollmer, Dayton, Ohio

[73] Assignee: Dayco Corporation, Dayton, Ohio

[21] Appl. No.: 851,091

[22] Filed: Nov. 14, 1977

[51] Int. Cl.[2] ..... B26F 1/32

[52] U.S. Cl. ..... 83/50; 83/454; 83/467 R; 83/743; 83/691; 269/87.3; 269/293

[58] Field of Search ..... 83/454, 456, 453, 553, 83/745, 690, 691, 684, 687, 467, 468, 50, 55, 743; 269/87.3

[56] References Cited

U.S. PATENT DOCUMENTS

| | | | |
|---|---|---|---|
| 40,030 | 9/1863 | Filkins | 269/87.3 |
| 113,737 | 4/1871 | Brooks | 83/467 X |
| 3,060,782 | 10/1962 | Burgess | 269/292 X |
| 3,227,018 | 1/1966 | Kravit | 83/553 X |

*Primary Examiner*—J. M. Meister
*Attorney, Agent, or Firm*—Reuben Wolk

[57] ABSTRACT

A printing blanket hole forming apparatus and method are provided and such apparatus has a support for supporting an end portion of a blanket thereon, a locating pin fixed to one end of the support, a template having at least one template locating hole therein and a set of openings therein associated with the one hole with the template being positioned by disposing the locating hole thereof around the pin with an end portion of a blanket supported on the support enabling forming of holes in the blanket by extending an associated hole forming device through the openings in the template and into the blanket and as determined by the openings in such template .

15 Claims, 4 Drawing Figures

PRINTING BLANKET HOLE FORMING APPARATUS AND METHOD

BACKGROUND OF THE INVENTION

Printing blankets are in wide use throughout the printing industry and a common technique for holding a printing blanket in position on a press is to form holes in opposite end portions of the blanket and use the holes to mount the blanket between pairs of rigid holding bars, or the like, having cooperating holes therein which receive suitable fasteners therethrough whereby such fasteners are used to urge the holding bars together sandwiching the blanket therebetween.

The usual procedure is to provide a suitable width blanket and then mark each hole location utilizing a marking device, such as a pencil or the like, whereupon the marking device is removed and holes formed through the blanket at the various locations marked with the holes usually being formed by employing a suitable punch and hammer.

The main problems associated with this procedure is that there is considerable chance for human error in marking and forming the holes resulting in considerable waste.

SUMMARY

It is a feature of this invention to provide an apparatus for forming holes in a printing blanket which overcomes the above-mentioned problems.

Another feature of this invention is to provide a printing blanket hole forming apparatus which is of simple and economical construction and which may be utilized by comparatively unskilled workers.

Another feature of this invention is to provide a printing blanket hole forming apparatus which may be used to provide precision holes in printing blankets having a plurality of different widths.

Another feature of this invention is to provide a simple versatile template of a forming apparatus of the character mentioned which is capable of being used to mark printing blankets having a plurality of different widths.

Another feature of this invention is to provide a printing blanket hole forming apparatus comprising a support for supporting an end portion of a blanket thereon, a locating pin fixed to one end of the support, a template having at least one template locating hole therein and a set of openings therein associated with the one hole with the template being positioned by disposing the locating hole thereof around the pin with an end portion of a blanket supported on the support enabling forming of holes in the blanket by extending an associated hole forming device through the openings in the template and into the blanket and as determined by the openings in such template.

Another feature of this invention is to provide a printing blanket hole forming method which enables forming of holes in associated printing blankets in a simple and economical manner by comparatively unskilled workers.

Accordingly, it is an object of this invention to provide a printing blanket hole forming apparatus and method having one or more of the novel features set forth above or hereinafter shown or described.

Other features, details, uses, objects, and advantages of this invention will become apparent from the embodiments thereof presented in the following specification, claims, and drawing.

BRIEF DESCRIPTION OF THE DRAWING

The accompanying drawing shows present preferred embodiments of the invention, in which.

DESCRIPTION OF ILLUSTRATED EMBODIMENT

Figure 1:
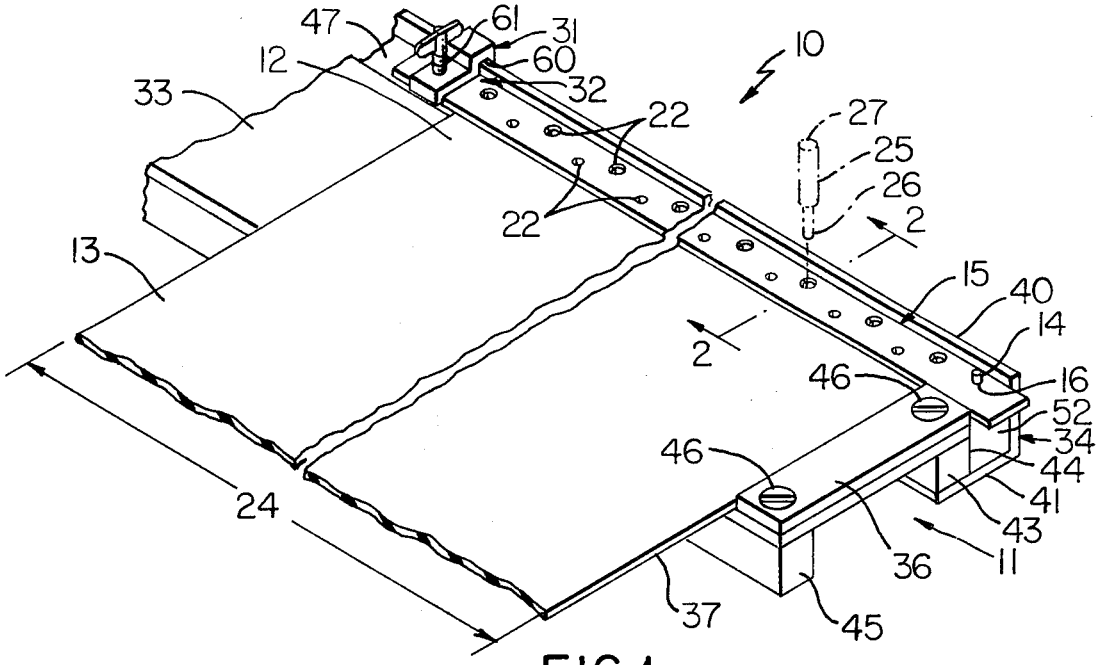
FIG. 1 is a perspective view with parts in cross section and parts broken away illustrating one exemplary embodiment of the printing blanket hole forming apparatus and method of this invention.

Reference is now made to FIG. 1 of the drawing which illustrates one exemplary embodiment of a hose forming apparatus of this invention which is particularly adapted for use in forming holes in a printing blanket or the like and such apparatus and method is designated generally by the reference numeral 10. The apparatus and method 10 comprise a support 11 for supporting an end portion 12 of a printing blanket 13 thereon; and, such apparatus and method 10 are particularly adapted to form precisely located holes in the end portion 12 of the blanket 13 while eliminating the previously mentioned problems associated with forming holes in printing blankets.

Figure 4:
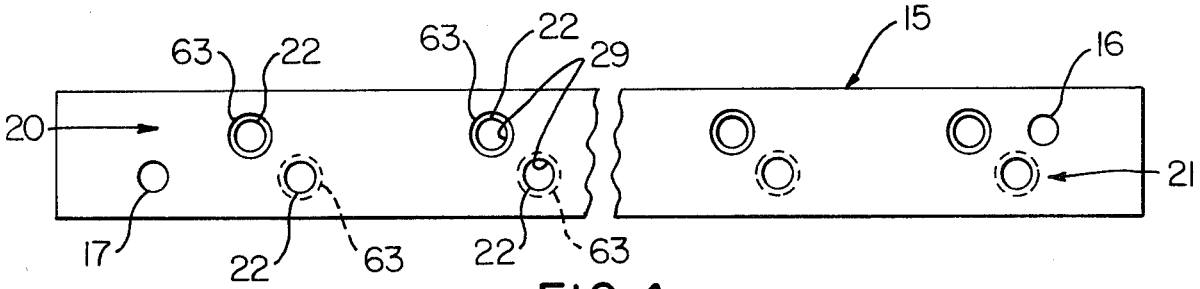
FIG. 4 is a plan view, with the center portion broken away, of an exemplary template comprising the apparatus of FIG. 1.

The support 11 has a locating pin 14 suitably positioned and fixed to one end thereof and a template 15, FIG. 4, which has a plurality (two in this example) of template locating holes 16 and 17 provided therein and a plurality of sets (also two sets in this example) 20 and 21 of openings in the template with set 20 being associated with template locating hole 16 and set 21 being associated with template locating hole 17. For ease of understanding and presentation the openings in each set 20 and 21 are each designated by the same reference numeral 22 with a representative few of such openings being thus designated.

Because of the plurality of two sets 20 and 21 of openings 22 the template 15 of apparatus 10 is particularly adapted to be used in forming holes in printing blankets having a plurality of two widths, and as will now be described in detail. For example, the template 15 is positioned by disposing its template locating hole 16 which is associated with set 20 of openings around the locating pin 14 enabling forming of holes 23 (FIG. 2) in the blanket 13 having a first width 24. The holes 23 are formed with the template 15 in position.

Although the hole forming device of apparatus 10 may be any suitable device employed in the art for this purpose such device is in the form of a punch 25 having a blanket piercing end 26 and a top surface 27 which is particularly adapted to be impacted by a suitable tool such as a hammer or the like which is designated schematically by an arrow 30.

Prior to forming or punching the holes 23 in the blanket 13 a clamp 31 comprising the apparatus 10 is suitably clamped in position as illustrated at 32 in FIG.

1. The clamp 31 provides a clamping action which prevents the blanket end portion 12 and template 15 from moving or shifting on the support 11 once the hole forming or punching action commences employing the punch 25 and this clamping action is produced by clamp 31 urging template 15 and blanket end portion 12 against support 11. Each opening 22 is defined at its lower portion by a right circular cylindrical surface 29 (FIG. 4) which serves as a precise guide for the end 26 of punch 25.

The apparatus 10 and template 15 are particularly adapted for forming holes in another blanket (not shown) of a second width using template locating hole 17 and set 21 of openings 22. Accordingly, template locating hole 17 is disposed around the hole locating pin 14 with an end portion of the second width blanket supported on the support enabling forming of holes 23 in the blanket of the second width with the hole forming device or punch 25 as determined by the set 21 of openings 22 in the template 15 associated with the second template locating hole 17. To achieve this forming of holes in the blanket having the second width, it will be appreciated that the template 15 is turned (upside down) so that the top surface shown in FIG. 4 is down whereupon the template is reversed end for end and placed with the template locating hole 17 around the locating pin 14. As described previously, the clamp 31 is clamped in position prior to the hole punching action.

Referring again to FIGS. 1 and 2 of the drawing it will be seen that the support 11 comprises a support plate 33 which has a front stop 34 associated therewith for stopping a front edge 35 of the blanket 13 thereagainst. The support plate 33 also has a side guide 36 operatively associated therewith for guiding and supporting a side edge 37 of the blanket 13 thereagainst. The front stop 34 is in the form of a L-shaped member having a vertically disposed leg 40 and a horizontally disposed leg 41 with the vertically disposed leg 40 having a vertical stop surface 42 for receiving the front edge 35 thereagainst. The horizontally disposed leg 41 is suitably fixed to the support plate 33; and, in this example of the invention a structural bar member 43 is disposed between the terminal outer edge portion of leg 41 and the inner end edge of the plate 33 and fastened with suitable fastening means (not shown) extending between the leg 41, member 43 and plate 33 to fix the three components together.

The inner end edge of the plate 33 is defined by a vertical planar surface portion disposed in vertical alignment with associated planar vertical surface portion of the member 43 to define a vertical surface at the inside edge of the plate 33 and such vertical surface is designated by the general reference numeral 44. The outer portion of the support plate 33 is suitably supported on and fixed to a rectangular bar member 45 and the side guide 36 is fixed against the plate 33 by a pair of threaded metal screws each designated by the same reference numeral 46. If desired, the screws 36 may extend through the plate 33 and be threadedly received in cooperating threaded openings in members 45 and 43.

The locating pin 14 is suitably fixed to the horizontal leg portion 41 of the front stop member 34 so that the pin 14 is disposed parallel to the front surface 42 and the vertical surface 44. The surfaces 42 and 44 are disposed in parallel relation.

Figure 2:
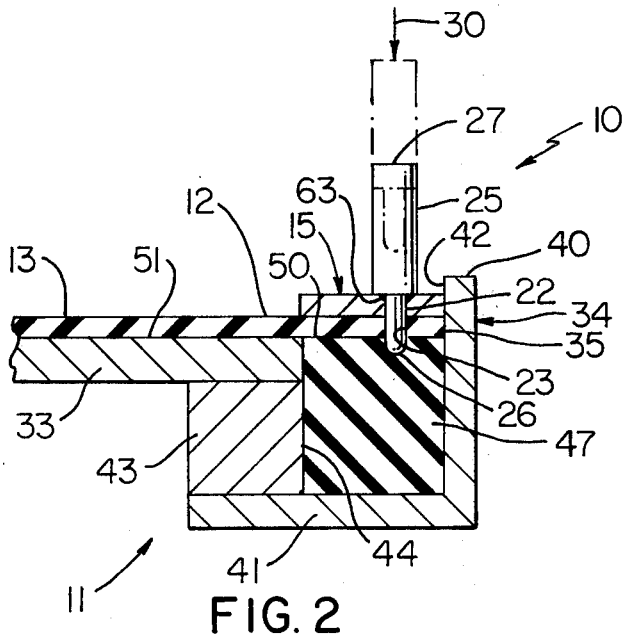
FIG. 2 is a fragmentary cross-sectional view taken essentially on the line 2—2 of FIG. 1 and illustrating, in elevation, a punch in its hole forming position and illustrating such punch by dot-dash lines in a position above the illustrated hole forming position.
Figure 3:
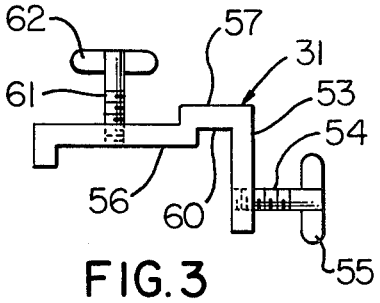
FIG. 3 is an end view of a clamp comprising the apparatus of FIG. 1.

The apparatus 10 also comprises a yieldable anvil which is designated generally by the reference numeral 47 and such anvil is disposed adjacent the front stop 34 and has a top surface 50 disposed substantially coplanar with the top surface 51 of the support plate 33. As seen in FIG. 2, the anvil 47 is disposed beneath the template 15 with the front edge 35 of the blanket 13 against the front stop 34 and in particular with edge 35 against the stop surface 42 of such front stop. The anvil 47 absorbs impact produced by the hole forming apparatus or punch 25. The anvil 47 has opposed parallel surfaces which fit snugley between the parallel surfaces 42 and 44 and the anvil 47 is in the form of a rectangular parallelepiped.

The anvil 47 may be provided with an opening therein which may be disposed around the locating pin 14; however, in this example of the invention a rigid block 52 is provided around the locating pin 14 and block 52 has a vertical end surface which is abutted by a cooperating end surface of anvil 47 and such end surfaces are not shown in the drawing.

The anvil 47 may be made of any suitable material known in the art; however, such anvil is preferably made of an elastomeric material and preferably in the form of a rubber compound. It will also be seen that the blanket 13 is illustrated in the drawing by cross-hatching as being made of rubber; however, it is to be understood that the blanket 13 may be of any suitable construction, with or without reinforcement, employed in the printing industry.

As previously explained, the apparatus 10 comprises the clamp 31 for clamping the template 15 against the blanket 13 and support 11. The clamp 31 has a vertical leg 53 which has a set screw 54 suitably threaded therein and provided with a handle portion 55. The set screw extends through associated threads in the leg 53 and by employing the handle 55 is particularly adapted to fasten the clamp 31 in position against the leg 40 of the front stop 34.

The clamp 31 also has a horizontal arm 56 which is attached to the vertical arm 54 by an L-shaped transition portion 57 and the L-shaped transition portion 57 cooperates with the upper portion of the vertical arm 53 to define a rectangular channel 60 which is particularly adapted to be received around the top end portion of the vertical leg 40 of the front stop 34. With the top end portion of the leg 40 received within channel 60, the set screw 54 is tightened thereby fixing the clamp 31 in position on the front stop 34 and hence the support 11. The clamp 31 also has another set screw 61 which extends through an associated threaded opening in its leg 56 and the set screw 61 also has a handle portion 62. Once the set screw 61 is tightened in position after fastening clamp 31 to the front stop 34 the template 15 is urged tightly against the end portion 12 of the blanket and both end portion 12 and template are firmly held enabling punching using punch 25 to be achieved without shifting of either the template 15 or blanket 13.

The various components comprising the support 11, template 15, and clamp 31 may be made of any suitable material known in the art and preferably such components are made of metal. Further, it will be appreciated that the hole forming apparatus such as the punch 25 is also made of any suitable material employed in making punches, such as hardened steel.

Each of the holes 22 provided in the template 15 preferably has a countersunk outer portion 63 adjoining its right circular cylindrical surface 29 and each portion 63 enables easier insertion and removal of the punch 25 in the forming of an associated opening 23 in the blanket 13.

In this example of the invention, a plurality of two sets, 20 and 21, of openings are provided in the template 15 associated with the two template locating holes 16 and 17 respectively. However, it will be appreciated that any desired number of template locating holes may be provided in a particular template and any desired corresponding number of sets of openings in the template may be provided. Accordingly, with such a template the number of different width printing blankets that may be punched is determined by the number of template locating holes and corresponding number of sets of openings.

It will also be appreciated that it is not necessary that the template be turned end for end and upside down to enable such template to be used with a plurality of different width blankets. This was done in this disclosure merely for ease of presentation.

In this disclosure of the invention the hole forming apparatus is shown in the form of a punch 25. However, it will be appreciated that the concept of this invention employing the apparatus 10 need not necessarily use punch 25 but may employ any suitable hole forming apparatus.

The clamp 31 in this example is shown as being provided with a downwardly projecting lip at the terminal end of its horizontal arm 56. However, it will be appreciated that such lip need not necessarily be provided. Similarly, it will be appreciated that in some applications of this invention the template 15 may be provided with suitable openings therein for receiving the terminal end of the set screw 61 therewithin.

In this disclosure of the invention the template 15 is provided with template locating holes 16 and 17 and corresponding sets 20 and 21 of openings 22 therein respectively whereby printing blankets of a plurality of two different widths may be suitably punched using the template 15 and as described earlier. It will be appreciated that for template locating hole 16 the spacing therefrom to the closest opening 22 of its set 20 is provided with precision as is the spacing (which may be equal) between the remaining holes 22 of set 20. Further, the placement of holes 22 of set 20 in template 15 is such that with a first width blanket the two holes 22 closest to the side edges of such first width blanket to be punched employing template 15 are equally spaced from such side edges. The same is true for template locating hole 17 and its set 21 of openings 22 associated with a second width blanket. Likewise, in a template 15 having more than two template locating holes and associated sets of openings for punching a corresponding number of more than two blankets the same type of spacing of each locating hole and spacing of holes in each set of openings is provided so that for each width holes 22 from the side edges of each blanket is the same and the spacing of intermediate holes 22 is in accordance with any desired spacing pattern.

While present exemplary embodiments of this invention, and methods of practicing the same, have been illustrated and described, it will be recognized that this invention may be otherwise variously embodied and practiced within the scope of the following claims.

What is claimed is:

1. A printing blanket hole forming apparatus comprising; a support comprising a support plate for supporting an end portion of a blanket thereon, said support plate having a front stop operatively associated therewith for stopping a front end edge of said blanket thereagainst, and said support plate having a side guide operatively associated therewith for guiding and supporting a side edge of said blanket thereagainst; a locating pin fixed to one end of said support; a template having at least one template locating hole therein and a set of openings therein associated with said hole, said template being positioned by disposing said locating hole thereof around said pin with an end portion of a blanket supported on said support enabling forming of holes in said blanket with an associated hole forming device with said device first extending through the openings in said template and then through said blanket to form holes in said blanket as determined by said openings in said template; and a clamp for clamping said template against said blanket and support at a location remote from said locating hole.

2. An apparatus as set forth in claim 1 and further comprising a punch which defines said hole forming apparatus and a yieldable anvil supported adjacent said front stop and having a top surface disposed substantially coplanar with a top surface of said support plate, said anvil being disposed beneath said template with said front edge of said blanket against said front stop to absorb the impact of said punch.

3. An apparatus as set forth in claim 1 in which said front stop comprises an L-shaped member having a vertically disposed leg provided with a vertical stop surface for receiving said front edge of said blanket thereagainst and having a horizontally disposed leg fixed to said support plate, said horizontally disposed leg receiving said yieldable anvil therewithin and said horizontally disposed leg having said pin fixed thereto in parallel relation with said vertical leg.

4. An apparatus as set forth in claim 3 in which said yieldable anvil is made of an elastomeric material.

5. An apparatus as set forth in claim 4 in which said yieldable anvil is made of an elastomeric material in the form of rubber.

6. An apparatus as set forth in claim 5 in which each opening of said set of openings has a countersunk outer portion for easier insertion and removal of said punch.

7. An apparatus as set forth in claim 5 in which said anvil is in the form of a parallelepiped.

8. An apparatus as set forth in claim 1 in which said clamp has a pair of set screws provided thereon wherein one of said set screws is employed to fix said clamp on said support and the other of said set screws is employed to urge said template toward said support with said end portion of said blanket therebetween.

9. A printing blanket hole forming apparatus comprising; a support comprising a support plate for supporting an end portion of a blanket thereon, said support plate having a front stop operatively associated therewith for stopping a front edge of each blanket thereagainst, and said support plate having a side guide operatively associated therewith for guiding and supporting a side edge of each blanket thereagainst; a locating pin fixed to one end of said support; a template having a plurality of template locating holes therein and a plurality of sets of openings in said template, each set being associated with an associated template locating hole, said template being positioned for forming holes in a blanket of a first width by disposing a first locating hole thereof associated with said first width blanket around said locating pin with an end portion of said first width blanket supported on said support enabling forming of holes in said first width blanket with an associated hole forming device and as determined by the set of openings in said template associated with said first locating hole, and said template bing positioned for forming holes in a blanket of a second width by disposing a second locating hole thereof associated with said second width blanket around said locating pin with an end portion of said second width blanket supported on said support enabling forming of holes in said second width blanket with said hole forming device and as determined by the set of openings in said template associated with said second locating hole; and a clamp for clamping said template against said blanket and support at a location remote from said pin.

10. An apparatus as set forth in claim 9 and further comprising a punch which defines said hole forming apparatus and a yieldable anvil supported adjacent said front stop and having a top surface disposed substantially coplanar with a top surface of said support plate, said anvil being disposed beneath said template with each front edge of a blanket being punched against said front stop to absorb the impact of said punch.

11. An apparatus as set forth in claim 10 in which said yieldable anvil is made of an elastomeric material.

12. An apparatus as set forth in claim 11 in which each opening of each set of openings has a countersunk outer portion for easier insertion and removal of said punch.

13. A method of forming holes in a printing blanket comprising the steps of, supporting an end portion of a blanket on a support, fixing a locating pin to one end of said support, providing a template having at least one template locating hole therein and a set of openings therein associated with said one hole, positioning said template by disposing said locating hole thereof around said pin with an end portion of a blanket supported on said support, clamping said template against said blanket and support at a location remote from said locating hole, and forming holes in said blanket as determined by said openings employing an associated hole forming device by extending said device first through the openings in said template and then through said blanket to form corresponding holes in said blanket.

14. A method as set forth in claim 13 in which said forming step comprises punching said holes with a punch.

15. A method as set forth in claim 14 and comprising the further step of disposing a yieldable anvil on said support beneath said blanket and template to absorb impacting blows applied against said punch during said punching.

* * * * *